United States Patent [19]

Mathiesen et al.

[11] Patent Number: 4,783,197

[45] Date of Patent: Nov. 8, 1988

[54] COMPOSITION AND A METHOD OF CAPTURING SULPHUR

[75] Inventors: Mihkel Mathiesen, Summit, N.J.; Olle Nyström, Höganäs, Sweden

[73] Assignees: AB Carbogel, Helsingborg; Berol Kemi AB, Stenungsund, both of Sweden

[21] Appl. No.: 128,429

[22] Filed: Dec. 3, 1987

Related U.S. Application Data

[63] Continuation of Ser. No. 900,535, Aug. 26, 1986, abandoned, which is a continuation of Ser. No. 628,823, Jul. 9, 1984, abandoned.

[30] Foreign Application Priority Data

Jul. 14, 1983 [GB] United Kingdom ..... 8319033

[51] Int. Cl.[4] ..... C10L 1/32

[52] U.S. Cl. ..... 44/51; 44/90; 44/622; 110/347

[58] Field of Search ..... 44/51, 1 SR; 110/347

[56] References Cited

U.S. PATENT DOCUMENTS

| | | | |
|---|---|---|---|
| 3,514,273 | 5/1970 | Lee et al. | 44/51 |
| 3,540,866 | 11/1970 | Miller | 44/51 |
| 3,948,617 | 4/1976 | Withorn | 44/4 |
| 3,960,513 | 6/1976 | Agarwal et al. | 44/1 SR |
| 3,993,456 | 11/1976 | Cole et al. | 44/51 |
| 4,081,250 | 3/1978 | Hsu et al. | 44/1 R |
| 4,083,696 | 4/1978 | Cole et al. | 44/1 R |
| 4,092,125 | 5/1978 | Stambaugh et al. | 44/1 SR |
| 4,118,200 | 10/1978 | Kruesi | 44/1 R |
| 4,224,038 | 9/1980 | Masologites et al. | 44/1 SR |
| 4,226,601 | 10/1980 | Smith | 44/1 SR |
| 4,249,910 | 2/1981 | Masologites et al. | 44/1 SR |
| 4,261,701 | 4/1981 | Schulz et al. | 44/51 |
| 4,270,926 | 6/1981 | Burk et al. | 44/1 SR |
| 4,297,108 | 10/1981 | Horowitz et al. | 44/1 SR |
| 4,325,707 | 4/1982 | Kalvinskas et al. | 44/1 SR |
| 4,396,397 | 8/1983 | Kugel et al. | 44/51 |

FOREIGN PATENT DOCUMENTS

| | | |
|---|---|---|
| 3074977 | 11/1977 | Australia . |
| 0010289 | 4/1980 | European Pat. Off. . |
| 0013420 | 7/1980 | European Pat. Off. . |
| 0066817 | 12/1982 | European Pat. Off. . |
| 2501503 | 7/1976 | Fed. Rep. of Germany . |
| 2613471 | 10/1976 | Fed. Rep. of Germany . |
| 2947788 | 7/1981 | Fed. Rep. of Germany . |
| 980969 | 5/1951 | France . |
| 7900886 | 10/1982 | PCT Int'l Appl. . |
| 408307 | 5/1979 | Sweden . |
| 2002030 | 2/1979 | United Kingdom . |
| 2009783 | 6/1979 | United Kingdom . |
| 2009782 | 6/1979 | United Kingdom . |
| 2013714 | 8/1979 | United Kingdom . |
| 2035142 | 6/1980 | United Kingdom . |
| 2051123 | 1/1981 | United Kingdom . |

OTHER PUBLICATIONS

Slupek, Combustion of Aqueous Emulsions of Liquid Fuel, Chem. Abs. 87, 138316k (1977).

Van Ness, Operation of C-E Flue Gas Desulfurization System for High Sulfur Coal, Chem. Abs. 93, 52693t (1980).

Deashing of Coal, Chem. Abs. 98, 56952c (1983) JP 57 143 396.

Mizobuchi, Removal of Sulfur Oxide and Nitrogen Oxide, JP 56 159 291.

Abe, Coal-Oil Suspension Fuel Manufacturing, Chem. Abs. 92, 25403w JP 77/139,932, 79 73,805.

*Primary Examiner*—William R. Dixon, Jr.
*Assistant Examiner*—Margaret B. Medley
*Attorney, Agent, or Firm*—Gordon W. Hueschen

[57] ABSTRACT

The invention relates to a composition and a method of capturing sulphur emanating from burning carbonaceous fuel particles of an aqueous fuel composition which comprises about 60-80% by weight of carbonaceous fuel particles with an ash content of below about 5% by weight on a dry basis, about 0.05-2.0% by weight of a flow-enhancing chemical which includes a non-ionic dispersant, and a liquid carrier phase consisting essentially of water. The sulphur is captured prior to formation of gaseous sulphur oxides which become diluted on the gaseous phase during and after combustion, and involves the introduction of a sulphur captor which preferably is chosen from hydroxides, oxides or carbonates of calcium or magnesium on or in reaction-facilitating proximity to the burning carbonaceous fuel particles, thereby utilizing local chemical potential in the formation of locally or relatively stable sulphides at relatively low oxygen potentials, the sulphur being captured during the combustion phase as solid sulphide and subsequently, when the temperature drops as the solid combustion residue leaves the flame and the local oxygen potential rises, and sulphate formation occurs, as the sulphate. The amount of sulphur in the combustion off gas is accordingly greatly reduced according to the method of the present invention.

8 Claims, No Drawings

COMPOSITION AND A METHOD OF CAPTURING SULPHUR

This is a continuation of application Ser. No. 900,535, filed Aug. 26, 1986, which in turn is a continuation of Ser. No. 628,823, filed July 9, 1984, both now abandoned.

The combustion of coal and other carbonaceous fuels, with few exceptions, places a heavy burden on the environment owing to the release of sulphur oxides in the combustion off gas stream.

Various expensive and/or relatively inefficient methods have been devised to precipitate sulphur oxides from such off gases.

It is int.al. previously known, in the combustion of fuels consisting of liquid hydrocarbons, such as gasoline, fuel oil, slurries of liquid hydrocarbons and coal powder, and of coal, oil and water, to reduce the emission of forming $SO_2$ by adding different types of sulphur-capturing agents. As examples of this technique mention may be made of the following patent specifications.

DE No. 2,947,788 which describes a semiliquid fuel containing coal, water and certain thickening salts, such as sodium, potassium or calcium nitrates. The mixture may also include emulsified oil, anionic soap being added as emulsifier.

GB No. 2,009,783 which relates to a composition of a solid combustible material, such as coal, and a liquid fuel, such as gasoline, oil etc., and a gelling and ash modifying agent which is selected for example among metallo-organic compounds or inorganic compounds, such as pyrogenic silica, calcium oxide, calcium hydroxide, calcium carbonate etc. The modifying agent shall only keep the fuel particles apart and modify the melting point of the slag formed and has no sulphur-capturing function. The fuel composition further is devoid of dispersants.

GB No. 2,009,782 which substantially corresponds to the above-mentioned GB No. 2,009,783, with the difference, however, that one has added a special gelling agent which is combustible and for instance consists of carbon black, synthetic gums and resins.

DE No. 2,501,503 which describes the combustion in a fluidised bed, the off-gases from the bed being desulphurised with the aid of lime.

U.S. Pat. No. 3,514,273 which describes the addition to a liquid fuel, such as fuel oil, of an additive of magnesia and alumina.

U.S. Pat. No. 3,948,617 which describes the treatment of gaseous, liquid or solid fuels, such as coal powder, with sulphur neutralising alkali to neutralise sulphur dioxide which is formed during the combustion of the fuel. The alkali can be oxides of sodium, potassium, lithium, calcium, magnesium or aluminium, preference being given to sodium, potassium and lithium oxide.

SE No. 75 11947-9 which describes a fuel of coal particles in a water-in-oil emulsion, to which finely divided alkali, such as lime, can be added to eliminate sulphur dioxide at the combustion of sulphurous fuel.

U.S. Pat. No. 4,396,397 which describes a fuel which to the major part consists of fuel oil and to a smaller part of coal powder and an addition of 0.1–5% by weight of calcium acetate to reduce $SO_2$.

EP No. 00 66817 which describes a fuel which consists of coal powder, oil and water and a dispersion stabilising agent. The stabilising agent may int.al. be graphite or a water insoluble, inorganic hydroxide, such as silica, aluminium hydroxide, ferric hydroxide or titanium hydroxide.

The present invention relates to the capture of sulphur emanating from burning carbonaceous particulates prior to formation of gaseous sulphur oxides during combustion of an aqueous slurry of said carbonaceous particulates. This can be achieved by depositing a sulphur captor on or sufficiently near the burning carbonaceous fuel particles, thereby utilizing the local chemical potential in the formation of (locally) stable sulphides at relatively low oxygen potentials. Thus during the combustion phase sulphur is captured as solid sulphide. Subsequently, when the temperature drops as the solid combustion residue leaves the flame and the local oxygen potential rises (as a result of carbon burn-out), sulphate formation occurs. This is also a desirable reaction as it means that unreacted captor reacts with sulphur oxide in the gaseous phase to form stable, solid sulphate, thereby further reducing the amount of sulphur in the combustion off gas. Some of the sulphide formed also reacts with oxygen to form sulphate.

More particularly, the present invention relates to a method of capturing sulphur emanating from burning carbonaceous fuel particles upon burning of an aqueous slurry of said carbonaceous fuel particles, prior to the point at which gaseous sulphur oxides are formed, wherein (a) an aqueous fuel composition is provided which comprises about 60–80% by weight of carbonaceous fuel particles with an ash content of below about 5% by weight, on a dry basis, about 0.05–2.0% by weight of a flow-enhancing chemical which includes a non-ionic dispersant, and a liquid carrier phase consisting essentially of water, and (b) a sulphur-capturing substance which includes a compound of a metal with a higher affinity to sulphur than Fe is added to said composition in an amount of about 0.1–5% by weight of the compound calculated as pure metal upon total solid fuel weight.

In addition the invention also relates to an aqueous fuel composition in which sulphur emanating from burning carbonaceous fuel particles is captured prior to the point at which gaseous sulphur oxides are formed, wherein the composition comprises (a) about 60–80% by weight of carbonaceous fuel particles with an ash content of below about 5% by weight on a dry basis, about 0.05–2.0% by weight of a flow-enhancing chemical which includes a non-ionic dispersant, and a liquid carrier phase consisting essentially of water, and (b) a sulphur-capturing substance which includes a compound of a metal with a higher affinity to sulphur than Fe in an amount of about 0.1–5% by weight of the compound calculated as pure metal upon total solid fuel weight.

It is a requirement of the invention that the particulate carbonaceous fuel has an ash content of below about 5% by weight, on a dry basis. This is important in order to avoid slag formation problems due to the sulphur captor added. The requirement for a low ash content implies that the carbonaceous fuel, unless it consists of pure coal only, has to be purified before it can be used for the purposes of the invention.

Suitable captors are compounds of sulphide-forming metals such as calcium, magnesium, manganese, etc. It is essential that the captor be added to the fuel in such a way that the captor is well dispersed in the fuel. If it is present in the fuel in the form of solids, these must be of very fine size (below 10 micron size) in order to utilize the local thermodynamic conditions on or near the burning fuel particles.

The amounts in which the captor is added to the fuel are limited minimally by the amount of sulphur that is desired to be eliminated from the off gas. About 0.1 weight percent, preferably 0.3 weight percent, of the captor as pure metal based upon total solid fuel weight is a practical lower limit. The upper limit is indicated by the amount at which the captor begins to impede the combustion reaction, usually at or below about 5 weight percent, the preferred lower limit being about 0.5 percent.

It follows from the foregoing that the captor should be added in such a way to the fuel that sufficient proximity between captor and fuel particle can be achieved. This can ideally be achieved by adding the captor compound to a mixture of particulate coal and a liquid (essentially water) in which the coal is dispersed prior to passing the mixture through a burner device which atomizes the mixture, creating a spray of droplets containing one or more coal particles, captor and liquid. Prior to combustion there is rapid evaporation or volatilization of the water which deposits the captor, be it originally in solution or as a fine solid, and be it wholly or partly dispersed as fine solids in the water, or dissolved therein, on combustible sulphur-bearing solid fuel contained in the mixture.

It has been found that mixtures suitable for efficient energy conversion with simultaneous sulphur capture can effectively comprise:

(a) solid particulate carbonaceous fuel containing sulphur, such as coal of any rank, coke, solid refinery by-products or other sulphur bearing carbonaceous solids, and (b) liquid carrier phase consisting essentially of water, and (c) soluble and/or fine particular compounds of a sulphur capturing, sulphide-forming substance which includes a compound of a metal with a higher affinity to sulphur than Fe. Exemplary of such sulphur capturing substances are $Ca(OH)_2$, $CaCO_3$, $Mg(OH)_2$, MnO, or any others which can be selected by those skilled in the art.

It is further important for the purposes of the invention that the sulphur captor added does not consist of substances forming low melting slag products which give rise to problems at the combustion. These undesired substances above all consist of compounds of the alkali metals sodium, potassium and lithium which are not therefore comprised by the present invention.

It is further required for the purposes of the invention that the sulphur captor added shall not in itself have an environment contaminating effect or at a combustion of the fuel give rise to environment contaminating products. Thus, in the case of water soluble sulphur captor compounds, it is preferred that the anions be of such nature that the burning of the fuel containing the captor compound does not contribute to environmental pollution or combustion equipment corrosion or fouling. An example of a harmful anion is sulphate. Equally, certain metal ions can be harmful in that they may cause e.g. boiler corrosion or fouling. Such metals are e.g. sodium and potassium, as is well known to those skilled in the art. For this reason, the sulphur captor according to the invention preferably consists of metal oxides, metal hydroxides or metal carbonates, while such metal compounds as nitrates, sulphates, chlorides fall outside the scope of the invention. Preferably the sulphur capturing substance is selected from the group consisting of hydroxides, oxides and carbonates of calcium, magnesium and manganese.

It is required that the various components should be blended together so as to achieve efficient dispersion. In the most preferred case coal or other carbonaceous solid fuel particles of maximum size 20 to 500 microns are admixed with water, flow-enhancing chemical additives such as surface active water-soluble compound, and sulphur captor such as $Ca(OH)_2$ of essentially smaller particle size than 10 microns. The pH of the water can be varied so as to provide for suitable solubility of the captor, e.g. CaOH, therein. To achieve the effect aimed at by the invention, namely to capture the sulphur as a solid sulphide already before it has had time to oxidise to sulphur dioxide, it is necessary for the sulphur captor to come into intimate contact with the sulphur containing carbonaceous fuel particles. Therefore, the sulphur captor when in solid form has a particle size of below 10 $\mu$m. Furthermore, it is advantageous if the sulphur captor is soluble, wholly or partly, in the carrier liquid used (water or essentially water). At the combustion of the fuel the aqueous carrier liquid is evaporated and the carbonaceous fuel particles are surrounded by a coat of aqueous carrier liquid which continuously shrinks because of evaporation. The sulphur captor dispersed or dissolved in the carrier liquid will as a result deposit on the surface of the fuel particles and be in intimate contact with them when the carrier liquid has been wholly evaporated and the combustion of the particles begins. At this stage, the local oxygen potential at the particle surface is low and the formation of solid sulphide is favoured at the reaction with the sulphur captor. The intimate contact which is brought about according to the invention between the sulphur captor and the fuel particles and which is a prerequisite for the bonding of the sulphur at an early stage as sulphide, presupposes that the carrier liquid consists essentially of water and that it is non-combustible. For if the carrier liquid is a combustible liquid, such as oil, the above-mentioned evaporation process with the deposition of the sulphur captor in intimate contact with the fuel particles will not come about, but the carrier liquid is burnt also itself simultaneously with the fuel particles. It is further preferred that the solid fuel particles contain minimum amounts of non-combustible impurities which may combine with the sulphur captor during and after combustion, thereby creating low-melting compounds which might adversely affect the heat-transfer process. When using coal as the solid fuel, it is essential that the coal be physically beneficiated prior to combustion in order to minimize captor/coal ash reactions at high temperature. Such physical beneficiation normally lowers the acidity of the ash composition and therefore limits the possibility of low-melting captor/coal ash combustion residue formation.

The sulphur captor may be combined into the slurry at any point prior to combustion because the sulphur-capturing process occurs during and, to a minor extent, after combustion of the fuel, whereafter the captured sulphur is removed in the removal of particulates from the off gas stream.

Usual relative amounts of the fuel mixture components are:

(a) Carbonaceous fuel 60–80%, preferably 70 to 80%, by weight.

(b) Aqueous liquid, preferably water, 20–40% by weight, preferably 20 to 30% by weight.

(c) Sulphur captor, preferably a calcium compound, most preferably $Ca(OH)_2$, 0.1 to 5% by weight of the capturing compound, calculated as pure metal based upon total solid fuel weight, in whatever form it may be added.

(d) Flow-enhancing chemical, 0.05 to 2.0 percent by weight.

The flow-enhancing chemical must be of such a nature that the sulphur captor compound does not negatively interact with it, i.e. render the mixture non-pumpable. To this end, the flow-enhancing chemical must consist of or at least include as a major constituent a non-ionic dispersant. Preferred types of flow-enhancing chemicals are water soluble nonionic surface active compounds such as ethyloxylated nonylphenol or dinonylphenol with 40 to 90 repeated ethylene oxide units, especially when using sulphur captors such as ($Ca(OH)_2$ and $CaCO_3$. The selection of other such suitable chemicals and sulphur captors will be readily apparent to those skilled in the art.

In some instances, particularly when large amounts of sulphur captor are used (i.e. in an upper area of the preferred range 0.1–5 weight percent on dry fuel weight), it is preferred to add a solid captor, such as dolomite powder, or other compound containing the sulphide and sulphate forming metal(s), or mixtures thereof, in the form of dispersed captor slurry, comprising, for instance, sulphur captor, dispersant and water.

The foregoing describes a novel method of capturing sulphur during and after combustion of a sulphur-containing solid fuel slurry. The essential aspects of the invention are:

1. Dispersing the sulphur captor in the liquid phase of a solid fuel/liquid slurry, be it in the form of a fine particulate ($CaCO_3$, $CaCO_3.MgCO_3$, $Ca(OH)_2$, etc.) or in the form which is soluble in one or more liquids of the said liquid phase.
2. Firing the slurry in a combustion apparatus such as a boiler or a gasifier or any other combustion apparatus, whereby the following are caused to occur:

(i) Slurry is atomized, whereafter the liquid phase either evaporates or volatilizes, forcing a major fraction of the sulphur captor onto the solid fuel particles. This achieves two necessary goals.

The sulphur captor will be well and evenly distributed in the whole volume wherein combustion occurs and sulphur is released.

The fraction of the captor deposited on the fuel particles is particularly efficient in capture of the sulphur as sulphide at the high combustion temperature and low oxygen potential on or near the solid fuel particle. The reaction $$MeO+\tfrac{1}{2}S_2 \rightleftharpoons MeS+\tfrac{1}{2}O_2$$

(wherein Me is the sulphur-capturing metal, in oxidic form after initial calcining of carbonate or hydroxide)

is strongly forced to the right, since all available oxygen will be consumed in the combustion of carbon. A thin porous layer of MeO further ensures excellent utilization of the captor in that the sulphide formation is rapid and nearly complete. This is particularly the case when the captor compound is at least partly dissolved in the slurry liquid. Me can be Ca, Mg, Mn, or any other sulphide-forming metal with higher affinity to sulphur than Fe, but Ca is preferred. However, as mentioned before, the metal shall not form low-melting slags during the combustion, and therefore alkali metals and their compounds are not comprised by the invention.

(ii) As the combustion reaction nears completion, the temperature begins to drop relatively rapidly and the oxygen potential increases. In this phase, downstream of the flame region, the unreacted sulphur captor, MeO, reacts with sulphur oxide (formed in the combustion reaction by combustion air, oxygen and gaseous sulphur which escapes the sulphide-forming captor) to form $MeSO_4$. Further, some MeS may become oxidised to $MeSO_4$, which is a stable compound at the lower temperatures.

(iii) Thus, in the combustion gases having particulate solid suspended therein, a major fraction of the sulphur originally present in the fuel is chemically bound to the particulate material and only a minor fraction is present in the gaseous phase as SOx. The particulates are removed from the off gas stream using, for example, baghouses or electrostatic precipitators, whereby only minimal amounts of sulphur are released to the atmosphere.

It should also be noted that, if the solid fuel originally has an ash content of more than 5% by weight it must first be subjected to physical and, where applicable, chemical cleaning prior to its incorporation into the slurry which is to be atomized and burnt with added sulphur captor. This reduces impurities in the solid fuel such as, in the case of coal, inorganic sulphur and other inorganic species thereby (a) reducing the requirement for sulphur captor and (b) reducing the disadvantages of handling an impure fuel and combustion residue from impure fuel. This cleaning also means, that the sulphur captor may increase the temperature at which the ash melts in the furnace, thereby reducing the slagging tendency of the fuel. Using fuels with higher ash contents may give less desirable results, e.g. CaO, or other MeO, may combine with fuel ash to form low melting oxide mixtures (e.g. basic CaO combining with acid $SiO_2$) resulting in slagging problems impeding heat transfer processes in the combustion apparatus and inhibition of sulphur capture, it being commonly recognized that extensive coal cleaning to very low ash levels removes the acidic ash-forming components to a greater extent than the basic components.

The following Examples are given by way of illustration only, and are not to be construed as limiting.

EXAMPLE 1

200 kg of a coal/water slurry containing 72 weight percent coal was admixed with 3 kg of calcium hydroxide powder (less than 10μ size). The coat contained in the slurry was of Canadian origin (Cape Breton Development Corporation, Harbour seam coal) and was subjected to physical cleaning prior to incorporation in the aqueous slurry. The coal particle size was less than 200 μm and the approximate analysis was as follows:

| (dry basis) | |
|---|---|
| Fixed carbon | 64.10% |
| Volatiles | 34.50% |
| Ash | 1.40% |
| Total sulphur | 0.95% |

The slurry was fired in a vertically fired oil-design fire-tube boiler at 1.4 MW (thermal) load (approximately 60% of full load when oil fired). The off gas analysis showed that only approximately 21.9% of the sulphur originally present in the fuel occurred in the gaseous phase as $SO_2/SO_3$, indicating that an 78.17% efficiency in sulphur capture was achieved. This corresponds to an equivalent sulphur content in the slurry fuel coal of 0.21% as compared to the original 0.95%. The use of calcium hydroxide in the slurry fuel has accordingly been shown to be a very cost effective method of limiting sulphur oxide emission to the atmosphere when firing this particular type of coal/water slurry. The low coal ash content contributed to the absence of any boiler slagging problems during the test.

When other sulphur captors, such as $CaCO_3$, $Mg(OH)_2$ or MnO, are employed, the results are essentially the same.

EXAMPLE 2

Example 1 is repeated with the difference that magnesium hydroxide is substituted for the calcium hydroxide. The results obtained are essentially the same.

EXAMPLES 3 AND 4

Examples 1 and 2 are repeated at 60% coal by weight of total fuel weight. The results obtained are similar with regard to sulphur capture. (At coal loadings below 60%, however, the flame stability deteriorates rapidly unless support fuel is supplied.)

EXAMPLE 5

Example 1 is repeated with the difference that formic acid is added to the slurry to effect increased dissolution of the calcium hydroxide powder. This will also somewhat reduce the viscosity of the slurry. The sulphur capturing results are essentially the same.

What we claim and desire to secure by Letters Patent is:

1. A method of capturing sulphur emanating from burning carbonaceous fuel particles, upon burning of an aqueous slurry of said carbonaceous fuel particles, consisting essentially of the steps of:

(a) providing an aqueous carbonaceous fuel composition slurry having a continuous aqueous phase which consists essentially of about 60–80% by weight of carbonaceous fuel particles with an ash content of below about 5% by weight, on a dry basis, about 0.05–2.0% by weight of a flow-enhancing chemical which includes a non-ionic dispersant, and a liquid carrier phase consisting essentially of water, and (b) mixing into said aqueous slurry a sulphur-capturing substance, having a particle size when present in solid form of less than about 10 microns, which includes a compound of a metal with a higher affinity for sulphur than Fe and which is selected from the group consisting of hydroxides, oxides, and carbonates of calcium, magnesium, and manganese, in an amount of about 0.1 to about 5% by weight of the compound calculated as pure metal upon total solid fuel weight, thereby to provide uniform and intimate contact of such sulphur-capturing substance with said carbonaceous fuel particles in said slurry, thereby to provide conditions suitable for binding sulphur in said slurry as solid sulfide before conversion of said sulphur upon combustion into sulphur oxides, and thereafter (c) atomizing and combusting said aqueous slurry with binding of sulphur in said slurry as solid sulfide.

2. A method according to claim 1, wherein a beneficiated coal/water slurry is used as the aqueous fuel composition.

3. A method according to claim 1, wherein the sulphur capturing substance is a solid with a particle size of less than 10 μm.

4. A method according to claim 1, wherein the sulphur capturing substance is added to the composition in an amount of about 0.3–5% by weight, the capturing substance being calculated as pure metal based upon total solid fuel weight.

5. A combustible aqueous fuel composition suitable for atomization and combustion with binding of sulphur in said composition as solid sulfide, said composition consisting essentially of:

(a) an aqueous carbonaceous fuel slurry comprising a continuous aqueous phase and consisting essentially of about 60–80% by weight of carbonaceous fuel particles with an ash content of below about 5% by weight on a dry basis, about 0.05–2.0% by weight of a flow-enhancing chemical which includes a non-ionic dispersant, and a liquid carrier phase consisting essentially of water and, intimately admixed into said composition, (b) a sulphur-capturing substance having a particle size when present in solid form of less than about 10 microns which includes a compound of a metal with a higher affinity for sulphur than Fe and selected from the group consisting of hydroxides, oxides, and carbonates of calcium, magnesium, and manganese, in an amount of about 0.1 to about 5% by weight of the compound calculated as pure metal upon total solid fuel weight, thereby providing uniform and intimate contact of said sulphur-capturing substance with said carbonaceous fuel particles in said slurry and thereby to bind sulphur in said slurry as solid sulfide.

6. A composition according to claim 5, wherein the aqueous fuel composition is a beneficiated coal/water slurry.

7. A composition according to claim 5, wherein the sulphur-capturing substance is a solid with a particle size of less than 10 μm.

8. A composition according to claim 5, wherein the sulphur-capturing substance is present in the composition in an amount of about 0.3–5% by weight, the capturing substance being calculated as pure metal based upon total solid fuel weight.

* * * * *

UNITED STATES PATENT AND TRADEMARK OFFICE

CERTIFICATE OF CORRECTION

PATENT NO. : 4,783,197

DATED : November 8, 1988

INVENTOR(S) : Mihkel Mathiesen and Olle Nyström

It is certified that error appears in the above-identified patent and that said Letters Patent is hereby corrected as shown below:

Col. 3, line 39; "particular" should read -- particulate --

Col. 6, line 42; "acid" should read -- acidic --

Col. 8, line 3; "such" should read -- said --

Signed and Sealed this

Twenty-second Day of August, 1989

*Attest:*

*Attesting Officer*

DONALD J. QUIGG

*Commissioner of Patents and Trademarks*